US005588798A

United States Patent [19]

Fork

[11] Patent Number: 5,588,798

[45] Date of Patent: Dec. 31, 1996

[54] ROTATING MACHINE PART, IN PARTICULAR A ROTOR OF A CYCLOID SHIP'S PROPELLER

[75] Inventor: Werner Fork, Heidenheim, Germany

[73] Assignee: J.M. Voith GmbH, Germany

[21] Appl. No.: 481,329

[22] PCT Filed: Nov. 3, 1994

[86] PCT No.: PCT/EP94/03614

§ 371 Date: Jul. 5, 1995

§ 102(e) Date: Jul. 5, 1995

[87] PCT Pub. No.: WO95/12520

PCT Pub. Date: May 11, 1995

[30] Foreign Application Priority Data

Nov. 5, 1993 [DE] Germany ..... 43 37 761.0

[51] Int. Cl.[6] ..... F04D 29/00

[52] U.S. Cl. ..... 415/111; 415/175; 415/180; 416/146 A; 416/174

[58] Field of Search ..... 415/110, 111, 415/175, 176, 177, 180; 416/146 A, 174; 184/6.22, 104.1

[56] References Cited

U.S. PATENT DOCUMENTS

| | | | |
|---|---|---|---|
| 2,988,154 | 6/1961 | Hub . | |
| 3,371,719 | 3/1968 | Bear | 416/174 |
| 4,380,417 | 4/1983 | Fork | 416/111 |
| 4,668,168 | 5/1987 | Schilder et al. | 416/146 A |
| 4,795,273 | 1/1989 | Henriksson et al. | 416/174 |
| 5,462,406 | 10/1995 | Ridgewell et al. | 416/111 |

FOREIGN PATENT DOCUMENTS 861215 12/1952 Germany .

*Primary Examiner*—John T. Kwon

*Attorney, Agent, or Firm*—Ostrolenk, Faber, Gerb & Soffen, LLP

[57] ABSTRACT

The invention relates to a rotating machine part having, in particular, a flat housing or base with an essentially cylindrical outer wall or with symmetrically distributed projections which are arranged in particular in the form of a star, in particular a rotor (1) of a cycloid propeller, the cylinder axis or rotor axis being the same as the rotation axis and the machine part or housing rotating in an atmosphere or a medium which is able to transmit heat to a sufficient extent to produce a required cooling effect on the machine part or housing or in its interior. The invention is distinguished by the fact that a central introduction point is provided on the machine part or housing as well as return lines (12) for a further heat transmission medium, which return lines (12) each have an inlet for the heat transmission medium which is to be returned, which inlet is arranged in the radially outer region of the machine part or housing, and by the fact that the return point for the heat transmission medium which is to be returned is provided in the vicinity of the central axis or the central region (24) of the machine part or housing.

14 Claims, 2 Drawing Sheets

ROTATING MACHINE PART, IN PARTICULAR A ROTOR OF A CYCLOID SHIP'S PROPELLER

BACKGROUND OF THE INVENTION

The invention relates to a rotating machine part with a base or housing which rotates in a heat transmitting medium, particularly a cycloid propeller, and more particularly relates to heat transmission within the housing of the machine part. In the case of such a machine part. The example the wheel body of the cycloid propeller for example, oil which lubricates and cools the bearing points and the transmission circulates in the interior, from which the heat is emitted to the outside via the outer wall of the machine part to the medium. The oil should circulate in the interior in a suitable manner for this purpose. At the same time, the heat transmission surfaces of the machine part are in general located radially on the outside.

The object of the invention is significantly to improve the heat transmission with respect to the bearing point and cooling of the machine part.

SUMMARY OF THE INVENTION

This object is achieved according to the invention by using a heat transmitting liquid medium inside the rotor to flow outward toward the exterior wall of the rotor, particularly under the influence of centrifugal force, and then removing that liquid flow from the exterior and directing it toward the interior of the housing where it is collected for possible later reuse. The apparatus for accomplishing this includes a plurality of return lines arrayed around the interior of the rotating part or rotor. Each return line has an inlet for the returning heat transmitting liquid, which inlet is located in the radially outer region of the rotating machine part. Each return line returns the heat transmitting liquid medium to the vicinity of the central axis of the machine part.

Where the machine part is a cycloid propeller, the propeller includes a plurality of blades arrayed around the rotor axis, and the blades extend down, parallel to the rotor axis. The orientation of each blade around its long axis is adjustable. A central control rod is connected by respective coupling rods to each of the blades so that the control rod through the coupling rods determines the orientations of each of the blades with respect to the rotor as the rotor rotates.

The outlets from each of the liquid transmitting medium return lines are in the vicinity of the central control rod. Around the central control rod are means for collecting the returned heat transmitting medium. The heat transmitting medium within the rotor may be the lubricant which lubricates the individual blades of the cycloid propeller. The solution according to the invention produces a forced flow which makes very good use of the heat transmission capability of the lubricant (or else of other heat transmission mediums).

DESCRIPTION OF A PREFERRED EMBODIMENT

Figure 1:
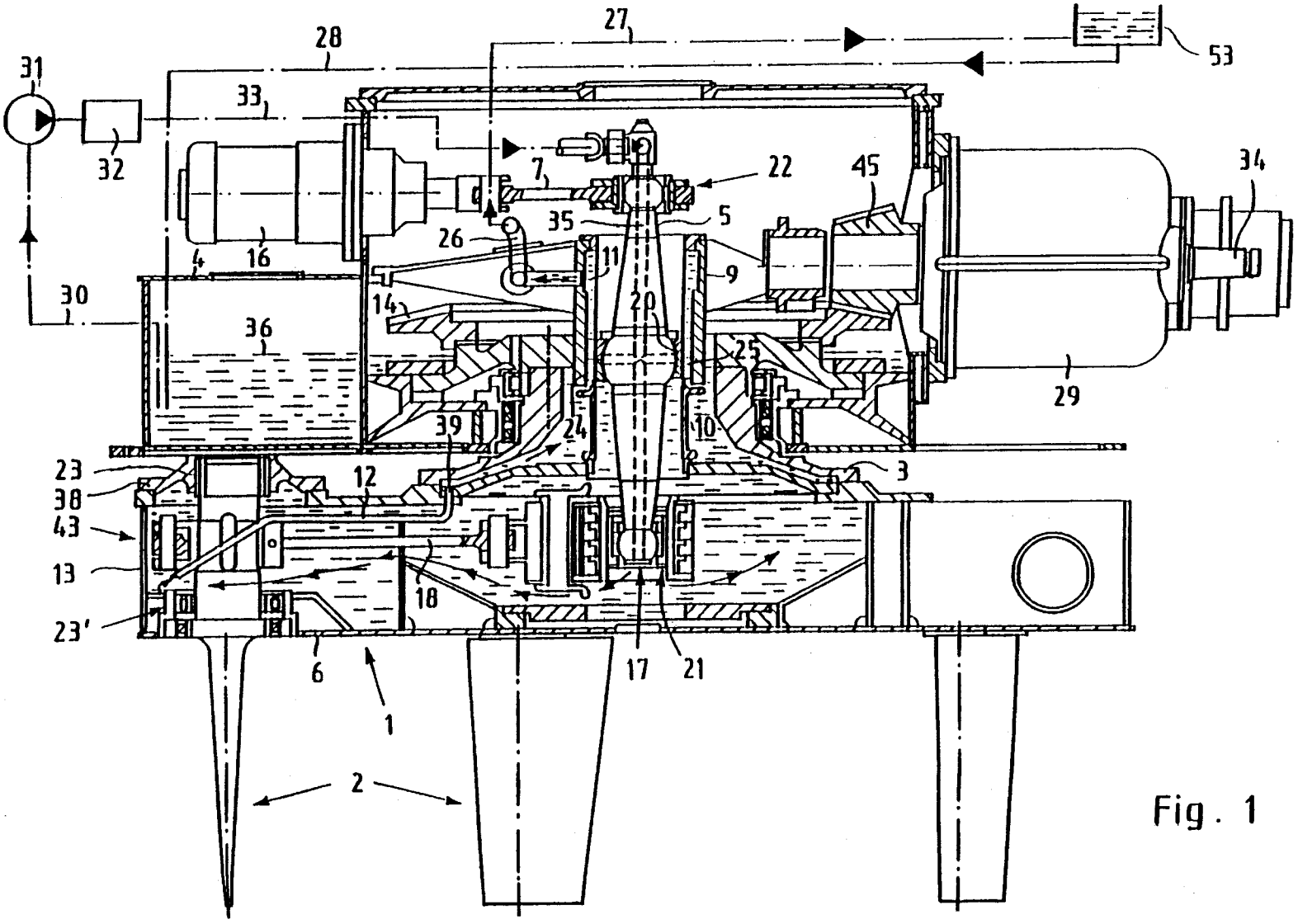
FIG. 1 shows an axial section through a ship's cycloid propeller.

In this case, the propeller comprises the stator 4 and rotor 1 as the main components, which rotor 1 is fitted with the individual blades 2 (in general five in number) by means of the blade bearing 23, 23'. A bearing plate 38 is in this case provided for the upper bearing 23. The rotor is in this case driven via the upper rotor part 3 and by means of the bevel gear 14, which is connected to it, via the bevelled pinion 45, the primary transmission 29, shaft journals 34 and the drive engine which is not shown here.

The propeller blades 2 are displaced in a known manner by the central control rod 5 which is mounted in the central, spherical main bearing 20 such that it can move in all directions. The displacement linkage 7, which originates from the hydraulic actuating motor 16, for displacing the control rod in one direction (for example for forward propulsion) acts on the rod 5 via an upper rod bearing 22. The displacement device in the direction at right angles to this (in the same horizontal plane) is not shown here since it would not be possible to see much of it anyway for drawing reasons. This displacement device is, however, of virtually similar design. The oil is fed from a pump 31 and is supplied in a metered fashion from a pressure valve 32 to the hydraulic actuating motors 16 and to the lubrication and bearing points, via lines which are not shown, in accordance with the requirement. The oil which is not required for these loads is supplied to the control rod 5 by the line 33.

Figure 2:
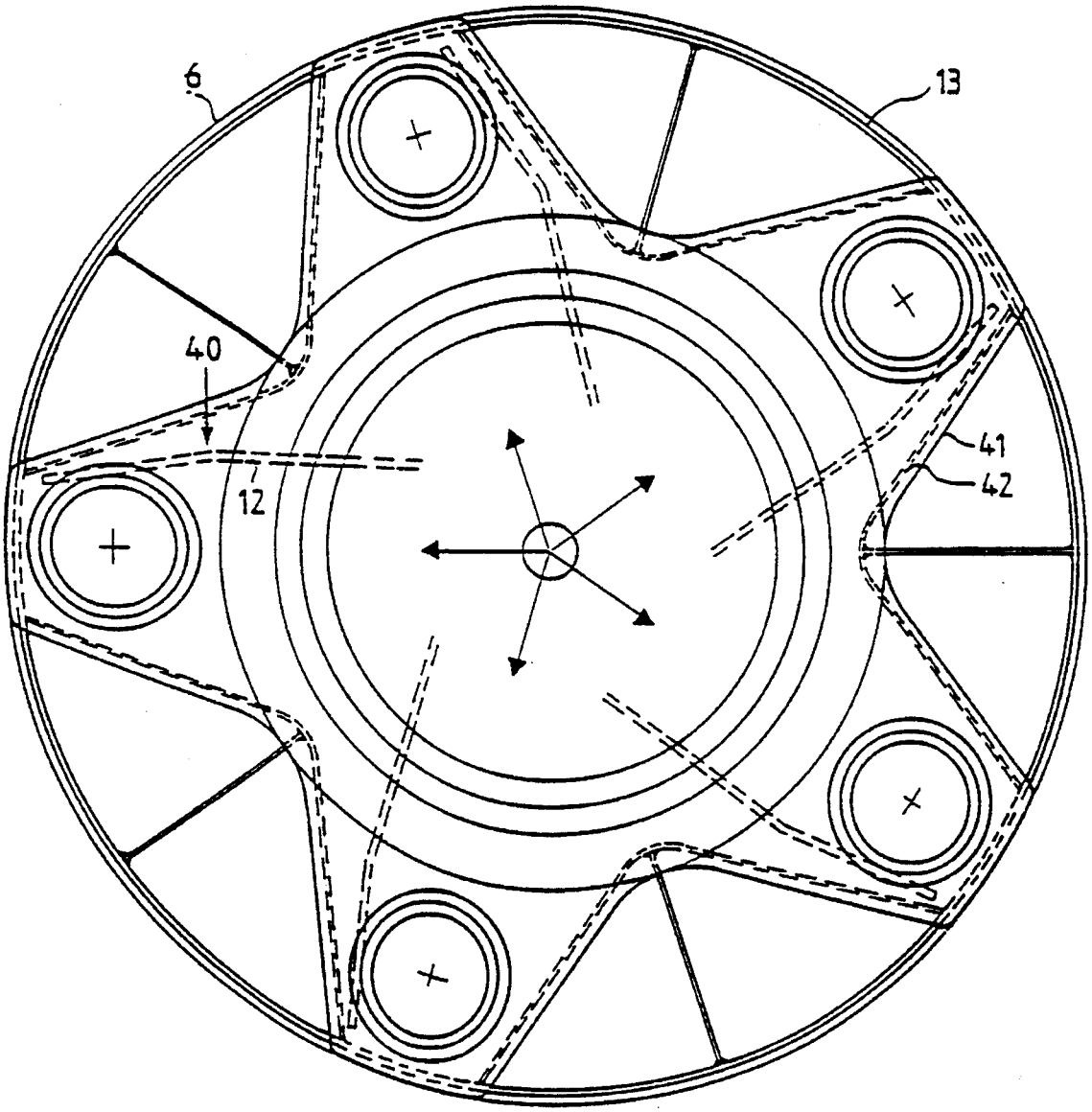
FIG. 2 shows a greatly simplified plan view of the rotor (the rotating machine part).

The control rod 5 displaces the individual blades 2 via the coupling rods 18 and, for this purpose, its lower part is surrounded by a control sleeve 21 and the latter is mounted on the lower end of the control rod. The central hole 35 for the lubricating oil opens by means of a central introduction location 17 into the lower part 6 of the rotor 1. This part is essentially a flat, cylindrical housing having a cylindrical outer wall 13. Pockets 40 for the bearing for the blades 2 are constructed in said housing by means of intermediate walls 42. The lower part of the rotor 1 is covered at the top by a covering plate 41 (see FIG. 2).

At least one return line 12 for the oil (heat transmission medium) leads out of each of these pockets 40. This return line 12 in each case starts in the radially outer region of the pockets and is connected to the upper rotor part 3 where it continues in an opening 39 in this part. After this, the oil rises further upwards through holes 24 and 25 which are produced in the central main bearing of the control rod. The oil passes from there into the oil housing 11 which, as a sheet-metal insert, is pushed into the bush-like rod housing 9. In order to ensure that the oil flows radially outwards from the central inner region in the rotor housing and back from there again to the more or less central region, an obstruction in the form of a seal carrier 10 is also provided around the rod, which obstruction is fitted on its upper region with a seal which produces a seal against the central main bearing 20 of the rod 5 but radially within the region in which the holes 24, 25 are. The further oil flow passes via lines 26 and 27 to a collector tank 53 from which the oil flows away via line 28 into an oil tank 36, which is arranged in the stator region and from which the pump 31 feeds the oil into the circuit again.

The invention is based on the following idea:

When a liquid-filled container is rotating uniformly, the liquid rotates to the same extent. The centrifugal forces in the liquid produce a pressure rise towards the outside in accordance with the formula $$P_r = \tfrac{1}{2} x \rho \times r^{2} \times w^{2} = \tfrac{1}{2} \rho \times u^{2}$$

where $P_r$=pressure at the radius r

ρ=density of the liquid r=radius on which the pressure is considered w=angular velocity of the container The pressure in the center is added to the pressures calculated in this way.

Any density differences within the liquid resulting from different phases, temperatures or mixtures lead to stratifications which are more or less stable. In the case of mineral oil of a standard type, a temperature difference results in a highly stable stratification if the warm oil is supplied in the center.

The stratification surfaces form paraboloids. The pressure in a stratification surface is constant.

Guideline values for propellers with blades of the type described:

ρ=900 kg/m$^3$, U=11 m/s (at the blade tip)

$P_r$=0.54 bar

The result of the above is that, without the measure according to the invention comprising the return pipes 12 and the seal carrier 10, it is not necessarily true that the warm oil reaches the outer surfaces of the wheel body. Specifically, after emerging from the lower end of the control rod 5, the warm oil would flow directly upwards again to the return holes. The outlet speed of the oil and the movement of the drive kinematics for the blades 2 cannot continuously influence this direct return flow. The broken down form of the wheel body with its pockets for the blade bearings 23 and 23' further suppresses greater mixing of the oil.

As a result of the measure according to the invention, the return lines pass the cold oil into a region close to the central region of the rotor where the oil is supplied to the circuit again. This oil throughflow results in the outer surfaces of the rotor housing 6 being wetted with the warm oil as far as the external diameter and in the oil which is cooled to the greatest extent being carried away from the bottom and top corners of the wheel body.

Thermal insulation of the return lines (of the return pipe) prevents the oil being reheated to a major extent. In general, even one return pipe 12 is in each case adequate for each pocket 40 of the lower rotor housing in order to carry the cold oil away in an optimum manner.

Other rotating heat exchangers and other rotating machine parts can also be designed on this principle.

I claim:

1. A rotating machine part having a base, an outer wall around the base, the rotating machine part defining a rotor having a rotation axis at the rotor axis, wherein the machine part is rotatable in a medium which is able to transmit heat away from the outer wall to a sufficient extent to produce a cooling effect on the rotor;

means toward the rotor axis for introducing a liquid heat transmission medium into the rotor and the rotor being shaped so as to permit the introduced transmission medium to move radially outward through the machine part;

a plurality of transmission medium return lines, each line having an inlet for the heat transmission medium to be returned and the inlet being arranged in the radially outer region of the rotor, the return lines being directed for delivering the heat transmission medium to the vicinity of the central axis of the rotor.

2. The rotating machine part of claim 1, wherein the base of the machine part is essentially a flat base toward the bottom of the machine part.

3. The rotating machine part of claim 2, wherein the outer wall of the base is essentially cylindrical.

4. The machine part of claim 1, wherein the rotor is the rotor of a cycloid propeller having a plurality of propeller blades arranged around the rotor; and the inlet to each of the return lines is generally in the region around the machine part of a respective blade of the propeller.

5. The rotating machine part of claim 4, and a stator which remains relatively stationary as the rotor rotates with reference to the stator; and the means for introducing the transmission medium is supported at the stator.

6. The machine part and rotor of claim 5, further comprising a rod extending centrally down through the base, and the means for introducing heat transmission medium being formed on the rod, a first sleeve around the rod and a further sleeve outward of the first sleeve for defining between the sleeves an annular channel around the rotor axis; the rod having a heat transmission medium introduction point toward the bottom of the base;

the heat transmission medium return lines having respective outlets which are above the heat transmission medium introduction point and are directed toward the region of the rod, so that the returned transmission medium flows up in the space between the sleeves around the central rod whereby the sleeves block the flow of heat transmission medium toward the center rod; and means for collecting the heat transmission medium which flows up between the sleeves.

7. The machine part of claim 5, wherein the rotor is the rotor of a cycloid propeller having a plurality of propeller blades arranged around the rotor; and the inlet to each of the return lines is generally in the region around the machine part of a respective blade of the propeller.

8. The machine part of claim 7, wherein the return lines each extend essentially radially inwardly from the respective inlet thereof.

9. The machine part of claim 7, wherein the return lines are arranged generally in the form of a star.

10. The machine part of claim 9, wherein the return lines deviate at most by 15° from the radial direction.

11. The machine part of claim 4, wherein the rotor is the rotor of a cycloid propeller for a ship and the heat transmission medium is the lubricant oil for the cycloid propeller and the blades thereof.

12. The machine part of claim 11, in combination with a stator with respect to which the machine part rotates, the cycloid propeller having a plurality of propeller blades arrayed around the rotor, and each of the propeller blades being supported for rotation in a respective bearing such that the orientation of the cycloid propeller blade is capable of being adjusted as the rotor rotates the blades around the axis of the rotor; each of the blades extending parallel to and being spaced out from the rotor axis;

a respective coupling rod connecting to each of the blades for controlling the orientation of the blade as the rotor rotates; a control rod extending parallel to the rotor axis; each of the coupling rods being connected to the control rod in such a manner that the position of the coupling rod with respect to the control rod is capable of being adjusted for orienting the rotation angle of each of the propeller blades with reference to the rotor as the rotor rotates; and means in the stator for controlling the orientation of control rod.

13. The machine part of claim 12, further comprising a rod extending centrally down through the base, and the means for introducing heat transmission medium being formed on the rod, a first sleeve around the rod and a further sleeve outward of the first sleeve for defining between the sleeves an annular channel around the rotor axis; the rod having a heat transmission medium introduction point toward the bottom of the base;

the heat transmission medium return lines having respective outlets which are above the heat transmission medium introduction point and are directed toward the region of the rod, so that the returned transmission medium flows up in the space between the sleeves around the central rod whereby the sleeves block the flow of heat transmission medium toward the center rod; and means for collecting the heat transmission medium which flows up between the sleeves.

14. The machine part of claim 5, wherein the return lines for the heat transmission means are directed to flow upwardly in the housing above an introduction location from the means for introducing the transmission medium;

a rotor bush on the rotor and extending up therefrom for at least partially blocking the upward flow of the heat transmission medium; and means for collecting the heat transmission medium which has flowed upward.

* * * * *